United States Patent [19]

Barton

[11] 4,236,242

[45] Nov. 25, 1980

[54] DUAL TIMER DEVICE

[76] Inventor: Lyndon O. Barton, 26 Shull Dr., Newark, Del. 19711

[21] Appl. No.: 68,460

[22] Filed: Aug. 21, 1979

[51] Int. Cl.[3] ..... G04F 1/04; G04B 37/00

[52] U.S. Cl. ..... 368/95; 368/316

[58] Field of Search ..... 58/1, 56, 144, 145 R, 58/145 D, 145 K, 153

[56] References Cited

U.S. PATENT DOCUMENTS 3,522,701 8/1970 Perry ..... 58/1 R

FOREIGN PATENT DOCUMENTS 50095 5/1911 Australia ..... 58/144

*Primary Examiner*—Edith S. Jackmon

[57] ABSTRACT

The Dual Timer invented makes use of two fluid-type timers arranged perpendicularly to each other in a simply designed hinged mechanism to measure and control playing time in concentration games such as Scrabble, chess and checkers. The mechanism has no moving mechanical parts and is manually operated.

4 Claims, 6 Drawing Figures

DUAL TIMER DEVICE

BACKGROUND OF INVENTION

Many competitive concentration games involving two opponents such as Scrabble, chess, and checkers can be not only time consuming, but also dull, particularly when players are not required to complete their plays within a specified time limit.

The object of this invention is to provide a device which will allot each player a fixed amount of time for the game (for example, 30 minutes for a 1 hour game), with the understanding that he or she will be penalized if he or she does not complete all of his or her plays in that time. Alternatively, the object is to provide the faster player the advantage of conserving more playing time than his or her opponent for later use if needed.

SUMMARY OF THE INVENTION

The Dual Timer, which comprises two fluid-type timers, arranged perpendicularly to each other in a hinged mechanism with its adaptable frame and base, is one simple timing device that not only ensures equal allotment of time between players but also keeps track of the accumulated times spent by each player during the course of the game.

The Dual Timer which has no moving mechanical parts is manually operated. Switching and resetting of the timers are each accomplished by simple one-step operations in which there is virtually no risk of malfunction.

DESCRIPTION OF THE PREFERRED EMBODIMENT

Figure 1B:
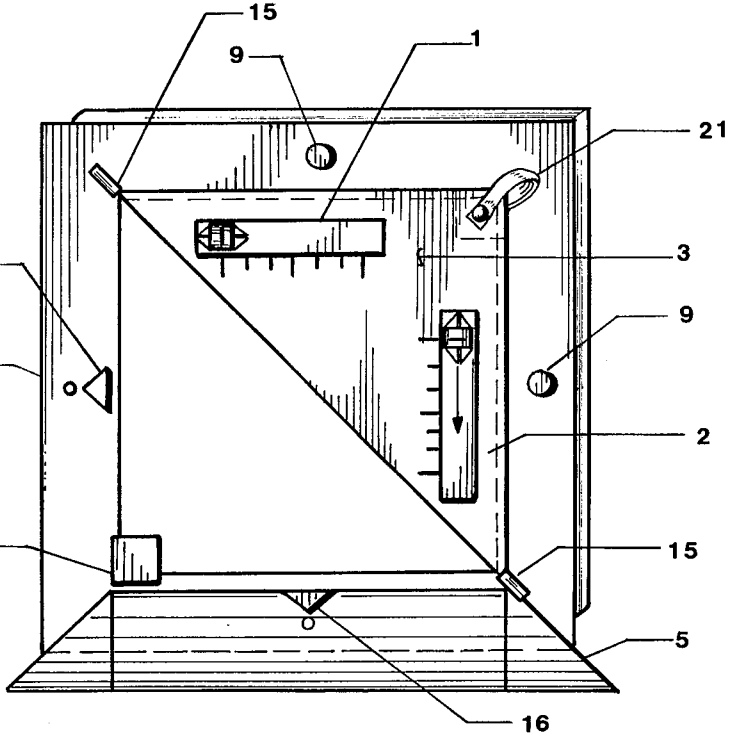
FIGS. 1A and 1B show Dual Timer in operation.

Operation:

The Dual Timer functions on the same principle as a typical chess clock. In the orientation shown in FIG. 1A, Timer 1, is set to time Player A, while Timer 2, is at rest being horizontal. Timer 1, therefore runs until Player A completes his move or play, whereupon he flips the holder 3, to assume the orientation in FIG. 1B. This automatically stops Timer 1, and starts Timer 2, (or Player B's timer). The process continues with each player taking turn until both timers (or the allotted times) run out.

In the event of a game interruption a situation that normally arises during a game of Scrabble, when a played word is challenged and has to be checked the Dual Timer assembly is laid flat so that both timers 1 and 2 are idle during that period.

To reset timers 1 and 2, the frame 4 is slipped out from the slotted support base 5, indexed 90°, and then re-inserted into the base 5.

Design Features:

The design depicted by the accompanying drawings is an exemplary and preferred embodiment of the Dual Timer invention.

The timers 1 and 2 are identical float-type devices, as described in U.S. Pat. No. 2,714,927. In a float-type device, time is measured based on the rate at which a float sinks in a viscous liquid when acted upon by gravity. In this case, the viscous liquid 7 can be a silicone fluid such as Dow Corning DC 200 whose viscosity is stable over a wide range of room temperatures, and the float 6 can be a plastic whose density is slightly greater than that of the liquid.

The timers 1 and 2 are positioned at right angles to each other so that the float in one timer is stationary when the other is moving under the influence of gravity.

Timers 1 and 2 are not size restrictive, nor are they type restrictive. They can be conveniently large or small depending on the timer period desired for the game, and they can be another form of fluid timer such as the granular hour-glass. The float-type timer has been selected for precision and design flexibility.

Timers 1 and 2 are calibrated to measure the elapsed times for individual plays, using graduation marks 18 shown.

The holder 3 is shaped in the form of a right triangle to conform with timer orientations.

The hinges 15 which serve to attach the holder 3 to the frame 4 along the diagonal of the frame are located on the diagonal of the holder 3. The diagonal of the frame is parallel to the hypothenuse of the triangle formed by the holder 3. These enable timers to be switched from one to the other as the holder 3 is rotated in the plane perpendicular to that in which the timers 1 and 2 are mounted.

Holder 3 can be color coded (see FIGS. 1A and 1B), using two contrasting colors (for example red and yellow), one on each face so that each player can identify with his or her timer at a glance.

The frame 4 is designed with plain edges 11 on two sides to permit proper insertion of those sides into the slotted support base 5, and beaded edges 12 on the other sides to prevent improper insertion of those sides into the base 5. The frame edges also prevent the Dual Timer assembly from freely standing on its sides, thus avoiding malfunction of the device.

The square opening 13 in the frame 4 provides a natural base for the holder 3 as it is held in one position or the other, and permits clear viewing of the timers 1 and 2 from behind.

The support base 5 is tapered at both ends 14 to eliminate the possibility of the Dual Timer assembly resting on those ends.

The notch 16 in the support base 5 is to facilitate proper positioning of the frame 4 during reset, using the matching wedges 17 affixed to the frame 4.

The wedges 17 also provide a stabilizing effect on the frame 4 in that they prevent it from rocking if the slot in the support base 5 is too loose.

Figure 2:
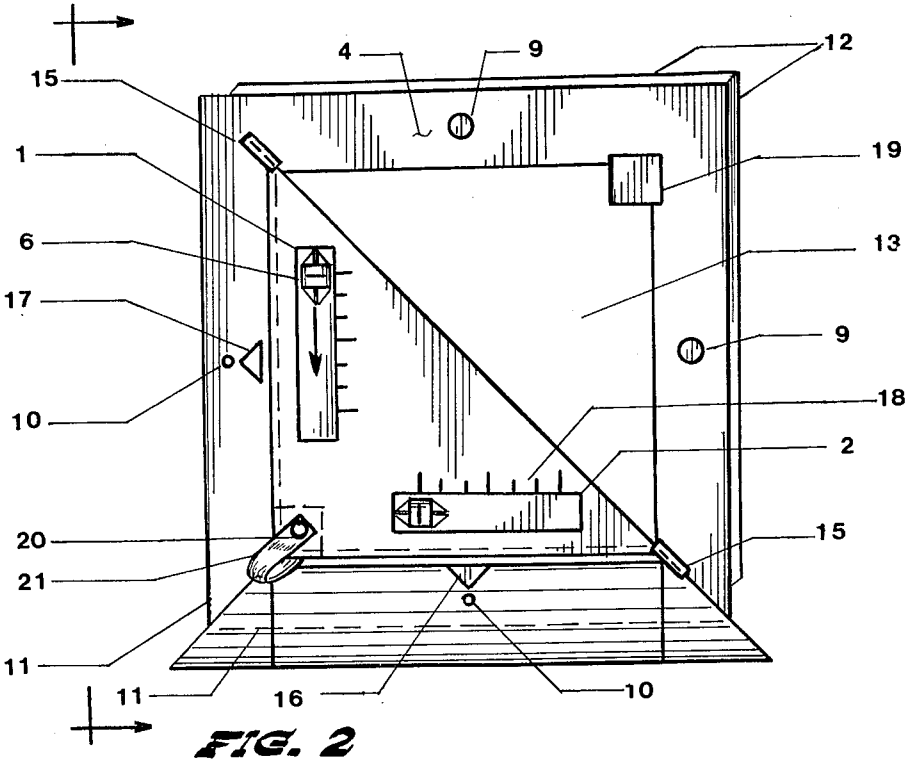
FIG. 2 shows the front view or face of the Dual Timer.
Figure 3:
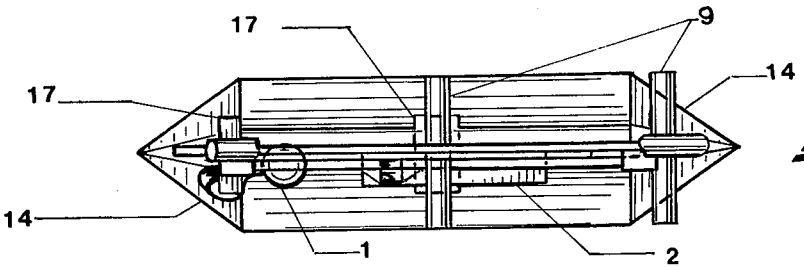
FIG. 3 shows the plan view of the Dual Timer.

In FIGS. 2 and 3, the pegs 9 on the frame 4 permit the Dual Timer assembly to assume a horizontal position when laid on a horizontal surface (for example, during a game interruption or intermission).

Figure 5:
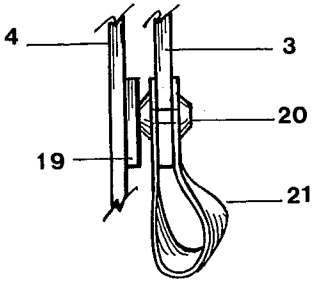
FIG. 5 shows detail of holder attachment.

As shown in FIGS. 2 and 5 the finger loop 21 is provided to conveniently handle the holder 3 using one finger to rotate the part.

The steel rivet 20, used to fasten the finger loop 12 to the holder 3, also provides magnetic attachment to secure holder to the magnetic pads 19 at the corners of the frame 4.

The holder securing device needs not be magnetic, provided it permits the holder 3 to be readily attached and detached between plays.

Figure 1A:
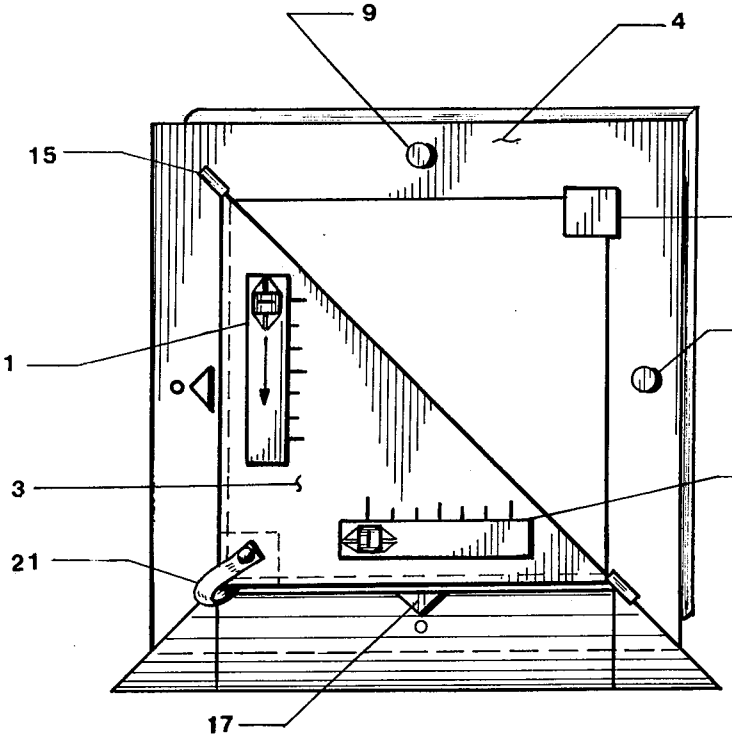
Figure 4:
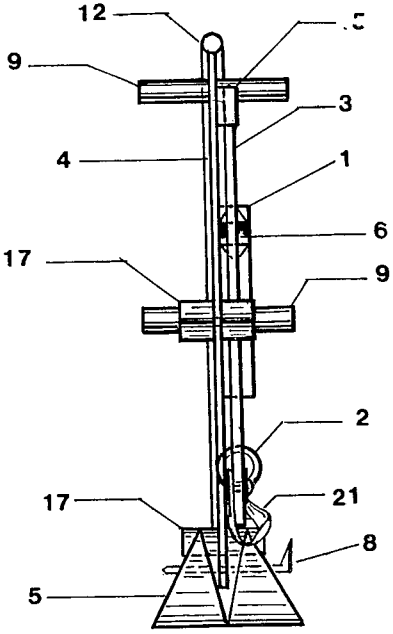
FIG. 4 shows the end elevation of the Dual Timer.

Referring to FIGS. 1B, 2 and 4 the holes 10 provided in the frame 4 and the support base 5 permit use of a locking pin 8 to lock the frame 4 and the support base 5 together. This affords portability of the Dual Timer as a unit, using the pegs 9 at the top of the frame 4 as a pair of handles.

Except as noted, all material can be plastic, wood, glass, or metal such as aluminum, or any combination thereof.

While the above description is at present considered to be a preferred embodiment of this invention, it will be obvious to those skilled in the art that various changes and modifications may be made therein without departing from the invention, and that it is the intent of said embodiment to cover all such changes and modifications that fall within the true spirit and scope of the invention.

What is claimed is:

1. A timing device comprising a hinged holder in the shape of a right triangle having two sides and a hypotenuse, two gravity actuated timers one of which is mounted parallel to one of said two sides and the other of which is mounted parallel to the other of said two sides, a frame in the shape of a rectangle, a base and a securing device to measure and control playing time in concentration games wherein;

a. the holder carries said timers and is hinged to the frame along a diagonal which is parallel to said hypotenuse such that said timers are rotatable in the plane perpendicular to that in which they are mounted, b. said frame and said base provide indexing means for said timers, c. said holder when in one direction rotating around said diagonal acting to stop one of said timers and when rotating in a direction opposite said one direction acting to stop another of said timers, and d. said securing device attaches said holder to said frame.

2. The timing device of claim 1, wherein the timers are of the float type.

3. The timing device of claim 1, wherein the timers are of the granular type.

4. The device of claim 1, wherein the securing device is magnetic.

* * * * *